US006247730B1

(12) United States Patent
Henderson et al.

(10) Patent No.: US 6,247,730 B1
(45) Date of Patent: Jun. 19, 2001

(54) BOOK

(75) Inventors: Barrie John Henderson; Simon Peter Couchman, both of Woodbridge (GB)

(73) Assignee: Top That Publishing plc, Suffolk (GB)

( * ) Notice: Subject to any disclaimer, the term of this patent is extended or adjusted under 35 U.S.C. 154(b) by 0 days.

(21) Appl. No.: 09/512,195

(22) Filed: Feb. 24, 2000

(30) Foreign Application Priority Data

Feb. 26, 1999 (GB) ..... 9904330

(51) Int. Cl.[7] ..... A63H 3/00; A47C 20/02

(52) U.S. Cl. ..... 281/51; 281/15.1; 281/17; 281/34; 283/63; 283/117; 446/72; 446/73; 446/74; 446/369; 446/327; 446/329; 446/372; 446/395; D21/483

(58) Field of Search ..... 283/117, 63; 281/15.1, 281/17, 34, 51; 446/72, 73, 74, 369, 327, 329, 372, 395; D21/483

(56) References Cited

U.S. PATENT DOCUMENTS

D. 368,489 * 4/1996 Gray ..... D19/26
3,715,816 * 2/1973 White ..... 281/31
4,434,536 * 3/1984 Schmidt et al. ..... 24/241 PP
4,832,648 5/1989 Theobald et al. .
4,874,340 * 10/1989 Smallwood ..... 281/29
4,909,542 3/1990 Marks .
5,059,149 * 10/1991 Stone ..... 446/73
5,472,364 12/1995 Castleman .
5,749,764 5/1998 Bailey .

* cited by examiner

*Primary Examiner*—A. L. Wellington
*Assistant Examiner*—Mark T. Henderson
(74) *Attorney, Agent, or Firm*—Howell & Haferkamp, L.C.

(57) ABSTRACT

A book has two covers and a set of book pages contained between the covers. The covers close to form a shape which has an external appearance resembling the head of a creature, with two eyes and a mouth. The two covers are joined to one another along a minor portion of the circumference, and are connected along the remaining portion of the said circumference by a releasable fastener such as a zip such that the fastener (the zip) forms the mouth. The pages of the book can be accessed by releasing the fastener and hinging open the two covers about the minor portion of the circumference.

20 Claims, 4 Drawing Sheets

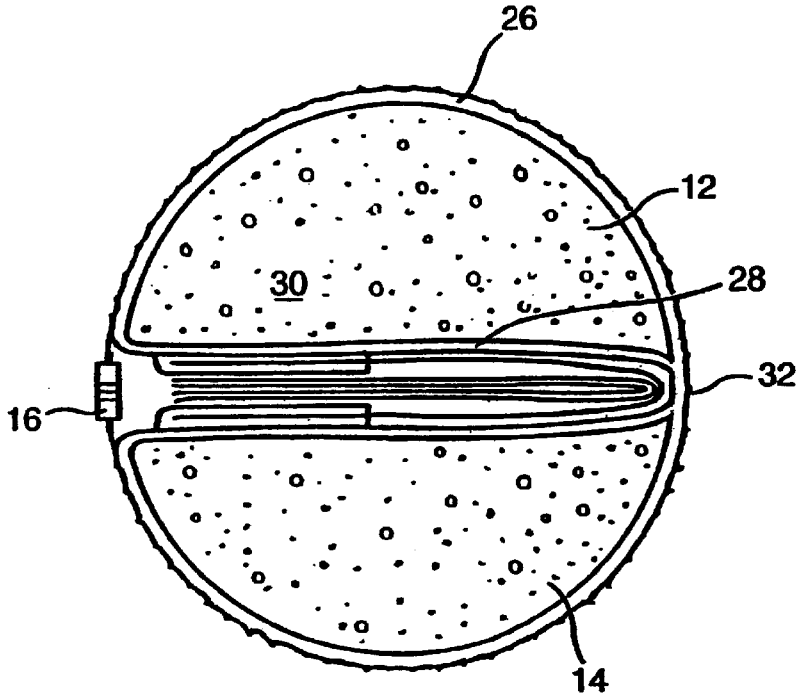
Figure 2
Figure 5
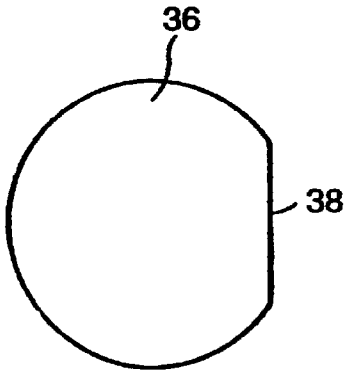
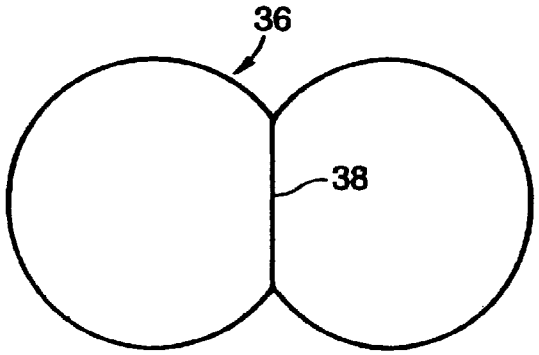
Figure 6

BOOK

This specification relates to a book, and also to a book construction.

Encouraging children to read books and to become familiar with the use of books is a very laudable desideratum. The present invention is aimed at providing a new format for the printed word which is likely to appeal to children.

According to the invention, there is provided a book having two covers which close to form a shape which has an external appearance resembling the head of a creature, with eyes and a mouth, wherein the two covers are joined to one another along a minor portion of the circumference, and are connected along the remaining portion of the said circumference by a releasable fastener such that said remaining portion of the circumference forms said mouth, and wherein the pages of the book can be accessed by releasing the fastener and hinging open the two covers about the minor portion of the circumference.

In the above, the term 'creature' includes not only animate creatures such as people and animals, but also inanimate objects such as spaceships or helicopters.

Making a book which has a secondary play value as a toy means that there can be two reasons for purchasing the item; first for its 'educational/instructional' value as a book, and secondly for its 'play' value as a toy.

The two covers are preferably hinged to one another and can be fastened together to close the book by means of a releasable fastener, such as a zip fastener, hook and loop fasteners (such as Velcro), buttons and buttonholes or the like.

The book can be generally spherical in shape, and approximately the size of a tennis ball, i.e., having a maximum external dimension of 100 millimetres. The spherical shape may be a somewhat flattened sphere. It is convenient if the book fits into the palm of a child's hand.

However larger dimensions can be used, and shapes other than spheres can be used. Appendages relevant to the creature being portrayed may be included. For example a book with covers in the form of a fish may have fins attached to the cover, or the eyes may be covered by (or represented by) a pair of sunglasses.

The two covers of the book are preferably closed by a fastener which extends around the remaining portion of the circumference through approximately 300 degrees of arc, with the minor portion of the circumference forming a hinge by which the two covers are joined.

The book preferably has means by which it can be attached to an external loop, for example a person's belt loop or an eye on a rucksack or similar. This attachment means may be a conventional lanyard clip, and can be attached to a zip slider or attached to a dedicated loop sown onto the surface of the book.

The insides of the two covers may have means for securing the first and last pages of the book so that when the covers are opened, the pages of the book are opened.

The book may be permanently fixed inside the covers or may be removable.

The peripheral shape of the book preferably corresponds to the peripheral shape of the covers, and the size of the book is such that it can be accommodated within the covers without distorting the external shape of the covers. The pages of the book are therefore likely to be very much smaller in total volume than the volume of the covers. The pages of the book will preferably be designed specifically to fit within covers of a specific shape.

The front and back covers are preferably faced in a fabric and filled with a compressible filling.

The invention will now be further described, by way of example, with reference to the accompanying drawings in which:

FIG. 2 is a cross-section through the book of FIG. 1;

FIG. 5 shows the outline of the pages for use in the toy of FIGS. 1 to 4;

FIG. 6 shows the pages of FIG. 5 fully open; and

Figure 1:
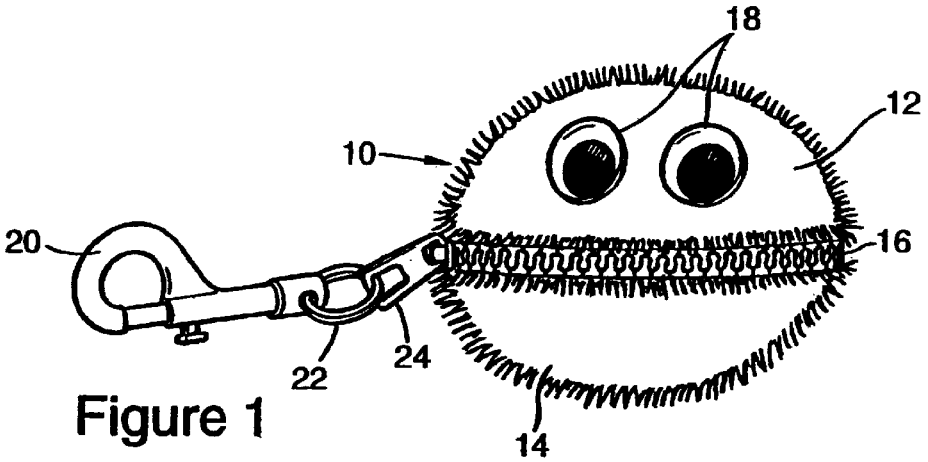
FIG. 1 is an external view of a book in accordance with the invention.

FIG. 1 shows an object generally designated 10 which is a somewhat flattened sphere. The object has two halves 12 and 14, and a zip fastener 16 joins the two halves. Each half has a fabric cover filled with a soft compressible filling. The outer cover may be smooth or furry, and the upper half 12 carries two eyes 18 attached to the fabric in a matter conventionally known in the manufacture of soft toys. It will be seen from FIG. 1 that the zip 16 gives the appearance of a mouth so that the object is generally animate in appearance.

A conventional lanyard clip 20 is attached by a ring 22 to the zip slider 24. This allows the object to be clipped to a key ring, to a belt loop or to some other part of a person's clothing or personal belongings.

FIG. 2 shows a cross-section through the object of FIG. 1. Each half 12, 14 has an outer covering 26 of fabric, and an inner web 28. A soft compressible filling 30 is trapped in each half between the outer cover 26 and the inner web 28. At the back of the object, the outer cover 26 extends at 32 between the two halves to form a hinge.

Figure 3:
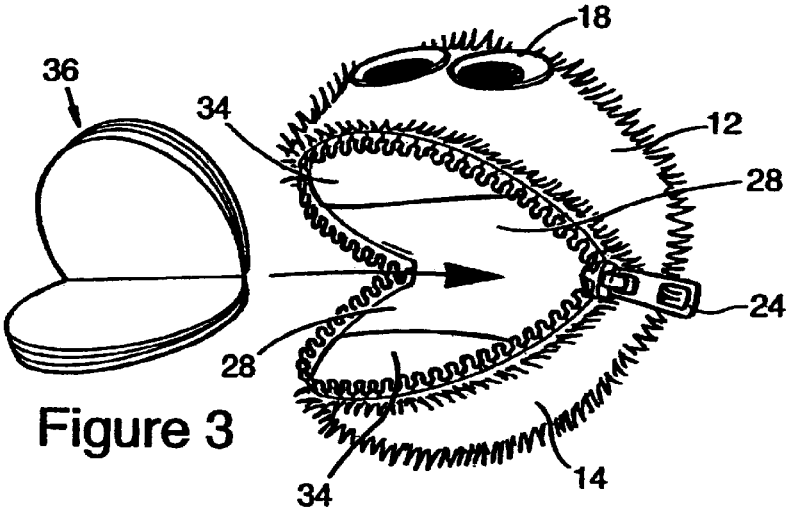
FIG. 3 shows the covers opened up ready to receive the pages of the book.

FIG. 3 is a perspective view of the object with the zip opened. It will be seen that the two halves of the toy open in the manner of a mouth, with the teeth of the zip being akin to the teeth in a mouth.

Figure 4:
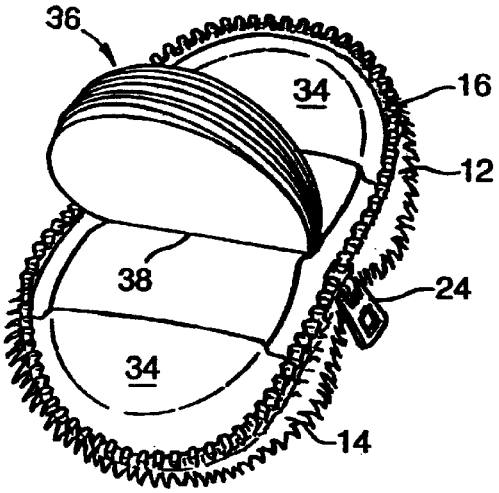
FIG. 4 shows the covers completely opened up with the pages in place and ready to be read.

Each web 28 which forms the inside of the mouth carries a pocket 34, and the first and last pages of a printed, book-like insert or booklet 36 can slide into these pockets, in the manner illustrated in FIG. 2 and FIG. 4, so that the halves 12 and 14 form covers for the book. The book will normally be permanently secured between the covers 12, 14.

FIG. 4 shows the book opened wide, in the position it will take up when the book is being read.

FIGS. 5 and 6 show the book or booklet (without its covers) in the closed position (FIG. 5) and in the open position (FIG. 6). It will be seen that the book has a spine 38. The pages will be stapled together by staples which lie along the spine or bound together by the use of adhesive (perfect bound). The pages will each have the generally circular shape shown in FIGS. 5 and 6, with the diameter of each page being such that it will fit within the pockets 34 and thus inside the closed covers.

To read the book the user will unzip the zip 16 to its fullest extent and open the book to the position shown in FIG. 4. The pages can then be turned over and read in the normal way.

The book is intended for children. The contents of the book will usually be suitable for reading by children. Although the book could contain printed matter, it could also be a picture book or a colouring book with pictures which can be coloured in, or the book could even have plain pages, without any printing on them at all, so that it could be used as a notebook. It could contain sticker material to form a sticker book.

The fabric cover 26 can be any suitable plain coloured or patterned fabric. The fabric can be smooth, furry or hairy and, in addition to the eyes, it could have other parts attached to it.

Figure 7:
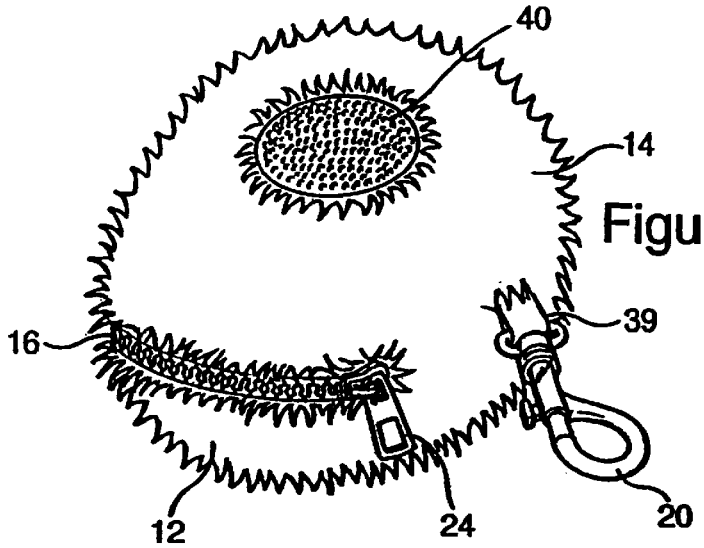
FIGS. 7–12 show a number of different embodiments of the invention.

A lanyard clip 20 or similar could be attached either to the zip slider 24 (FIG. 1), or to a separate loop sown into the outer face of the toy, as shown for example at 39 in FIG. 7.

FIG. 7 shows the under side of a toy in accordance with the invention, with a patch 40 of a hook-and-loop fastener (such as VELCRO (Registered Trade Mark)) so that the toy can be placed and retained on a suitable surface which will engage with the fastener on the patch 40.

Figure 8:
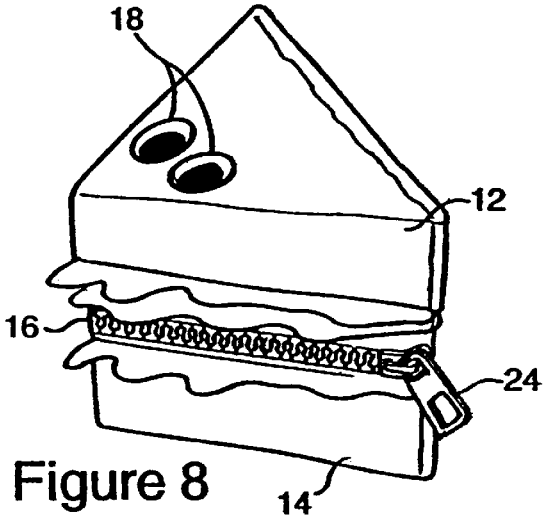

FIG. 8 shows a toy in accordance with the invention in a triangular shape, decorated to resemble a sandwich.

Figure 9:
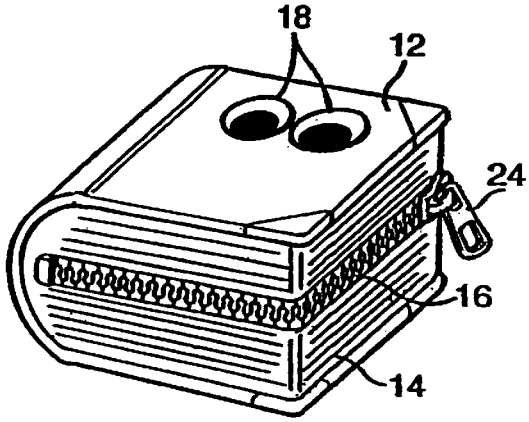

FIG. 9 shows a toy in accordance with the invention which is decorated to resemble a fat book.

Figure 10:
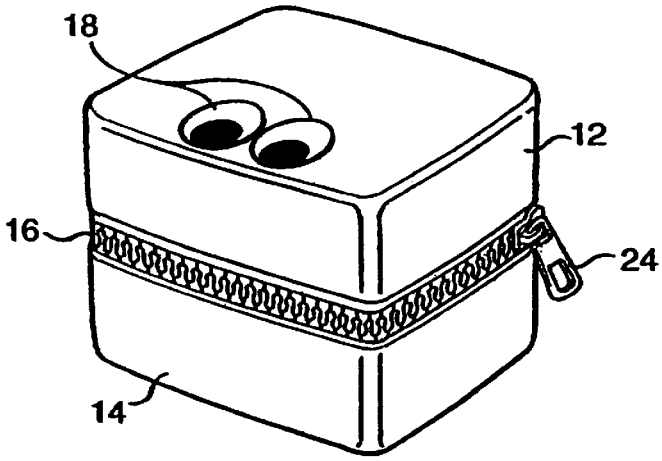

FIG. 10 shows a toy in accordance with the invention which is in the form of a square or oblong block.

Figure 11:
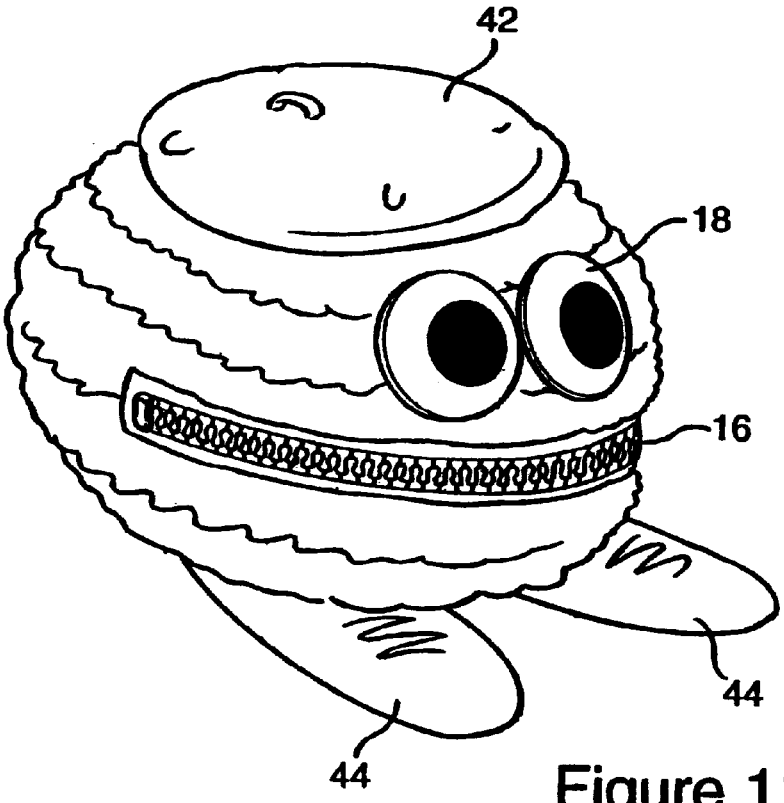

FIG. 11 is a toy in accordance with the invention which is decorated with a hat 42 and feet 44 to resemble a caricature of a person.

Figure 12:
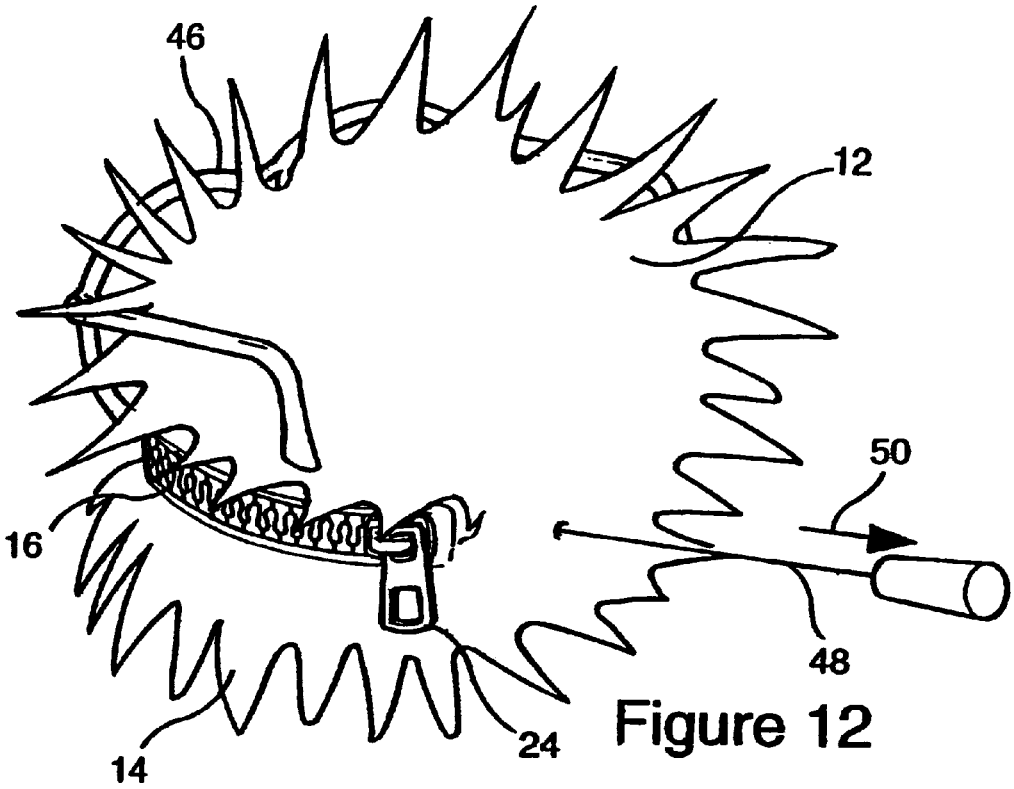

FIG. 12 shows a toy similar to FIG. 1. However this toy has an outer surface with rough hair, and is wearing sunglasses 46. Also, one of the halves 12, 14 (FIG. 2) of the toy contains an internal component which, for example, can play music or talk or vibrate or perform some other 'amusing' function. This component can be operated by pulling a pull-cord 48 as indicated by an arrow 50 to either tension a clockwork spring, or to directly operate an mechanism. Alternatively (although not shown in the drawings) there may be a battery or other electrically operated device housed within one part of the toy.

It is of the essence of the invention that the toy should be appealing to children, and the decoration can therefore incorporate a wide variety of features that will appeal to children. In addition to the shapes shown, the toy could for example take the form and design of a football or of a hamburger, but an almost infinite variety of designs is possible. The zip fastener 16 could be made with coloured teeth and/or the tapes on either side of the zip teeth could be coloured, either the same colour or different colours. The colours of the teeth could vary along the length of the zip.

Instead of a zip, some other means may be provided for fastening the two halves of the toy together. A zip fastener is particularly appropriate because of the way in which it mimics a mouth, but a flap with a press-stud or a Velcro fastening, or a buckle with a strap could equally well be used instead.

The filling within the spaces 30 can be any material conventionally used for stuffing soft toys, including pelleted fillings.

The exterior of the books can be manufactured so that a group of them form a set. For example they could be manufactured in the colours of a football team.

Instead of the lanyard clip 20, the book could have a wrist strap or a wrist loop to enable it to be attached to a person or another object.

It is not intended that the book insert 36 should be removable by the user. The subject matter of the book may relate to the form or decoration of the covers.

A wide variety of different forms is possible, making the books attractive to children and encouraging them to read.

What is claimed is:

1. A book comprising a plurality of pages and two covers, the covers each having a periphery separating an interior portion from an exterior portion of each of the covers, each of the covers being operatively connected to the other along a minor portion of its periphery in a manner such that the covers can be pivoted between open and closed positions relative to each other, the pages being permanently secured to the covers and being positioned where they will be sandwiched between the covers when the covers are in the closed position and where the pages can be turned when the covers are in the open position, the exterior portions of the covers being configured in a form of a head of a creature having a mouth, the mouth having a border formed by at least a portion of the periphery of each of the covers such that the mouth appears to be open when the covers are in the open position and appears to be closed when the covers are in the closed position.

2. The book of claim 1, further comprising a releasable fastener, the fastener being positioned on the book where it can releasably hold the covers in the closed position.

3. The book of claim 1, further comprising a loop sewn to the external portion of at least one of the covers, the loop having sufficient strength to support the book from an external member when such an external member is passed through the loop.

4. The book of claim 1, further comprising a means for attaching the book to an external loop of another object.

5. The book of claim 1, wherein the pages have a shape similar to the periphery of the covers.

6. The book of claim 1, further comprising at least one appendage relevant to the creature being portrayed, the at least one appendage extending from the exterior portion of at least one of the covers.

7. The book of claim 1, wherein the covers are shaped such that the book is generally spherical when the covers are in the closed position.

8. The book of claim 1, wherein the covers have a volume and the pages have a volume, the volume of the pages of the book being significantly less than the volume of the covers.

9. The book of claim 1, wherein each of the covers is faced in fabric and filled with a resiliently compressible filling.

10. The book of claim 1, wherein the pages of the book are concealed from view when the covers of the book are in the closed position.

11. The book of claim 2, wherein the fastener extends along substantially all of the portion of the periphery of each of the covers that forms the border of the mouth.

12. The book of claim 4, further comprising a releasable fastener, the fastener being positioned on the book where it can releasably hold the covers in the closed position.

13. The book of claim 4, wherein the fastener is a zipper that extends along substantially all of the potion of the periphery of each of the covers that forms the border of the mouth, the zipper having a zipper slider for releasably holding the covers in the closed position and the means for attaching the book to an external loop of another object being a lanyard clip attached to the zipper slider.

14. The book of claim 5, further comprising a means for attaching the book to an external loop of another object.

15. The book of claim 5, further comprising a releasable fastener, the fastener being positioned on the book where it can releasably hold the covers in the closed position.

16. The book of claim 15, further comprising a means for attaching the book to an external loop of another object.

17. A book comprising a plurality of pages and two covers, the covers each having a periphery separating an interior portion from an exterior portion of each of the covers, each of the covers being operatively connected to the other along a minor portion of its periphery in a manner such that the covers can be pivoted between open and closed positions relative to each other, the pages being positioned where they will be sandwiched between the covers when the covers are in the closed position and where the pages can be turned when the covers are in the open position, the exterior portions of the covers being configured in a form of a head of a creature having a mouth, the mouth having a border formed by at least a portion of the periphery of each of the covers such that the mouth appears to be open when the covers are in the open position and appears to be closed when the covers are in the closed position.

18. The book of claim 17, further comprising a releasable fastener, the fastener extending along substantially all of the portion of the periphery of each of the covers that forms the border of the mouth and being positioned on the book where it can releasably hold the covers in the closed position.

19. The book of claim 17, wherein the pages have a shape similar to the periphery of the covers.

20. The book of claim 17, wherein the pages are removably attached to the covers of the book.

* * * * *